US007123855B2

(12) United States Patent
Yuan et al.

(10) Patent No.: US 7,123,855 B2
(45) Date of Patent: Oct. 17, 2006

(54) SEALING STRIP FOR TONER CARTRIDGE AND METHOD FOR MAKING SAME

(76) Inventors: Yongjian Yuan, 7-8-504, Anningli South Area, Qingha Xiaoying, Haidian District, Beijing (CN) 100085; Lei Shi, 702, 7 Caoqiao, Zhongguancun, Haidian District, Beijing (CN) 100080; Zhiyun Huang, 7-8-504, Anningli South Area, Qinghe Xiaoying, Haidian District, Beijing (CN) 100085

( * ) Notice: Subject to any disclaimer, the term of this patent is extended or adjusted under 35 U.S.C. 154(b) by 218 days.

(21) Appl. No.: 10/929,263

(22) Filed: Aug. 30, 2004

(65) Prior Publication Data

US 2005/0054371 A1 Mar. 10, 2005

(30) Foreign Application Priority Data

Sep. 9, 2003 (WO) ..... PCT/CN03/00762

(51) Int. Cl.
*G03G 15/08* (2006.01)

(52) U.S. Cl. ..... 399/106

(58) Field of Classification Search ..... 399/91, 399/102, 103, 105, 106; 222/DIG. 1
See application file for complete search history.

(56) References Cited

U.S. PATENT DOCUMENTS 5,523,828 A * 6/1996 De Kesel ..... 399/103
5,876,541 A 3/1999 Chitouras ..... 156/94
6,041,202 A 3/2000 Cornelius ..... 399/106
6,552,780 B1 * 4/2003 Michlin et al. ..... 399/106
6,782,220 B1 * 8/2004 De Kesel et al. ..... 399/106
6,909,865 B1 * 6/2005 Nagashima et al. ..... 399/106

FOREIGN PATENT DOCUMENTS

CN 1224861 A 8/1999
CN ZL01266096.5 7/2002

* cited by examiner

*Primary Examiner*—Hoan Tran
(74) *Attorney, Agent, or Firm*—Suiter West Swantz pc llo

(57) ABSTRACT

The present invention is an improved sealing strip for sealing the toner chamber slot of a toner cartridge, and its manufacturing method. A sealing strip for toner cartridges includes a sealing film and a double-faced sealing film adhered thereto. The sealing film includes, along a first direction, a sealing portion for sealing a toner chamber slot of a toner cartridge and a pull part extending along one end of the sealing portion. The pull part is used for tearing away the sealing portion. The sealing portion includes two openings adjacent the pull part. The two openings range from 0.5 to 3.5 millimeters in length. The sealing film includes, along a second direction substantially perpendicular to the first direction, a prime layer and a guide layer. The guide layer includes two guide lines substantially parallel to each other and extending along the first direction. The two guide lines intersect the two openings. The double-faced sealing film is adhered to the sealing portion.

27 Claims, 6 Drawing Sheets

SEALING STRIP FOR TONER CARTRIDGE AND METHOD FOR MAKING SAME

CROSS-REFERENCE TO RELATED DOCUMENTS

The present application claims priority under 35 U.S.C. 365(a) and under 35 U.S.C. 365(c) to International Patent Application No. PCT/CN03/00762, filed Sep. 9, 2003, which is herein incorporated by reference in its entirety.

FIELD OF THE INVENTION

The present invention relates to a sealing strip for sealing a toner chamber slot of a toner cartridge and its manufacturing process.

BACKGROUND OF THE INVENTION

Large numbers of used toner cartridges from printers and photocopiers have become a significant issue in office environmental protection throughout the world, and it is feasible to recycle the used toner cartridges and reuse them. Many manufacturers have refilled used toner cartridges with toner and then re-sealed them for reuse, thereby reducing the environmental pollution arising from the discarded toner cartridges used in printers and duplicators. In the process of reusing and re-processing the used toner cartridges, the sealing method is different from that of an OEM. When making brand-new toner cartridges by OEMs, the toner chamber slots are sealed using adhesives and by heating and pressure. However, in the case of reprocessing used toner cartridges for reuse, the common practice is to seal the toner chamber slot using high-performance double sealants to tightly adhere the sealing material to the peripheral edges around the toner chamber slot.

There exist some disadvantages in the conventional technology in terms of the sealing strips used by OEMs for sealing the original toner cartridges and those used for sealing the recycled old toner cartridges in the recycling sector, as well as the manufacturing methods thereof. The Chinese Patent Application Publication No. CN1224861, published on Aug. 4, 1999 disclosed a sealing component, a process cartridge, and a developer supply container. The disclosed sealing component is used as the sealing strip for sealing toner cartridges, including (horizontally) a sealing portion, an elongated portion as well as the edges for connecting the sealing portion to the elongated portion, and vertically (in thickness) a surface layer, a laser beam blocking layer, a guide layer fusible by laser beams, and a sealing layer for adhering the sealing component to the toner cartridge slot. The sealing portion is provided with a tearable portion that can be torn, around the edges of which there are holes to form guide lines. These holes are shaped by the partially fused guide layer by laser beams on the sealing component. This sealing component is complicated in the processing process. Additionally it is unable to make the tearable portion have a width equal to the elongated portion (in practice, an equivalent width is the ideal status) due to the limitation to the processing technique. Thus, connection has to be made by means of connecting edges with a specific shape. The manufacturing process for this kind of sealing components is as follows: First, laser beams are projected onto the sealing component's blanks using a laser device to make guide lines consisting of many holes on the guide layer. Then, the sealing component's blanks are placed into a die, with multiple sealing components made by die stamping. The disadvantages of this technique includes: (1) a laser device is expensive and highly costly, and the cost becomes more prohibitive for the small lot production; (2) two separate devices are needed for forming guide lines by laser scanning and the die stamping of the sealing component's external contour, therefore increasing the manufacturing cost, and (3) it is also impossible to obtain relatively higher precision (hence making the elongated portion unable to have a width equal to the guide lines, accordingly connecting edges are needed for connection).

The foregoing-described sealing components are used by OEMs for sealing the original toner cartridges. In addition, there are also some sealing components used for sealing used toner cartridges in the recycling sector, e.g. the sealing strip disclosed in U.S. Pat. No. 6,041,202 (filed on Jul. 6, 1999, and issued Mar. 21, 2000), and China Patent No. ZL01266096.5 (filed on Nov. 19, 2001, and issued on Jul. 31, 2002). The sealing material used in these sealing strips is a type of non-woven fiber ribbon material, which is strenuous to tear and hard to form openings with consistent width when being torn (e.g., the torn sealing strip may become broadened, narrowed or obliquely pulled, or become laminated due to offset, or have low opening precision).

Therefore, it would be desirable to provide an improved sealing strip for sealing a toner chamber slot of a toner cartridge and its manufacturing process.

SUMMARY OF THE INVENTION

It is an object of the present invention to overcome the foregoing described shortcomings and provide an improved sealing strip for toner cartridges. The present sealing strip is simple in machining process, moreover the tearable portion between the two guide lines of the sealing portion is easier to tear with effort saving and without the problems like becoming broadened, narrowed or obliquely pulled, laminated etc.

It is an additional object to provide a more advanced method to make the sealing strip for toner cartridges. The present method has a higher machining precision, making the present sealing strip easier to tear. Furthermore, the present method may enhance the production efficiency and lower the production cost. In addition, the present invention provides very good flexibility and quite strong adaptability. The present invention is not only applicable to the mass production of sealing strips of the same model, but also can satisfy the demand for the production of sealing strips of multiple models in small lots.

In an exemplary aspect of the present invention, a sealing strip for toner cartridges includes a sealing film and a double-faced sealing film adhered thereto. The sealing film includes, along a first direction, a sealing portion for sealing a toner chamber slot of a toner cartridge and a pull part extending along one end of the sealing portion. The pull part is used for tearing away the sealing portion. The sealing portion includes two openings adjacent the pull part. The two openings range from 0.5 to 3.5 millimeters in length. The sealing film includes, along a second direction substantially perpendicular to the first direction, a prime layer and a guide layer. The guide layer includes two guide lines substantially parallel to each other and extending along the first direction. The two guide lines intersect the two openings. The double-faced sealing film is adhered to the sealing portion.

In an additional exemplary aspect of the present invention, a method for manufacturing a sealing strip for toner cartridges, comprising steps as follows. First, a sealing film is made. The sealing film includes, along a first direction, a sealing portion for sealing a toner chamber slot of a toner cartridge and a pull part extending along one end of the sealing portion. The pull part is used for tearing away the sealing portion. The sealing portion includes two openings adjacent the pull part. The two openings range from 0.5 to 3.5 millimeters in length. The sealing film includes, along a second direction substantially perpendicular to the first direction, a prime layer and a guide layer. The guide layer includes two guide lines substantially parallel to each other and extending along the first direction. The two guide lines intersect the two openings. Then, there is a double-faced sealing film corresponding to a shape and dimensions of the sealing portion. Next, the double-faced sealing film is attached onto the sealing film. The guide lines, the openings, and external contours of the sealing portion and pull part are all cut out by a cutting tool.

It is to be understood that both the foregoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
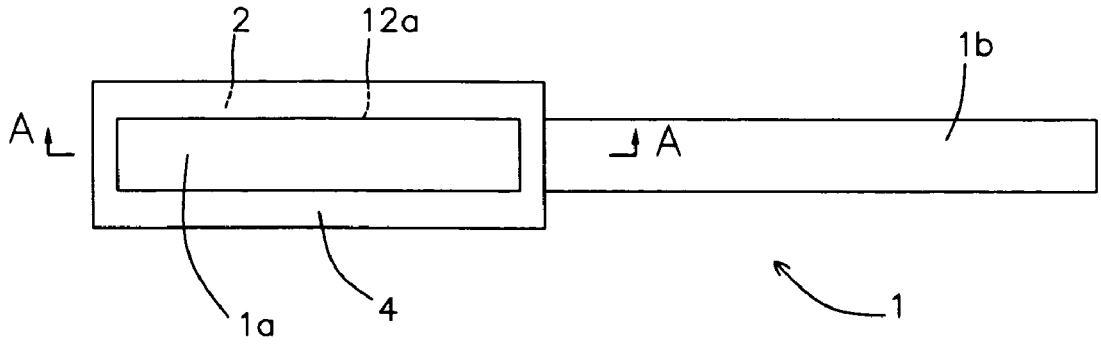
FIG. 1 is a front view of a sealing strip for toner cartridges in accordance with an exemplary embodiment of the present invention.
Figure 2:
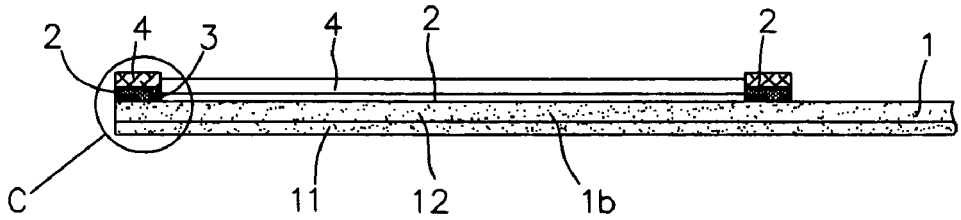
FIG. 2 is a sectional view of a sealing strip for toner cartridges in accordance with an exemplary embodiment of the present invention, with the location of its sectional view crossed along A—A section in FIG. 1, and only the pull part is indicated partially in the view for the sake of clearness.

Referring first to FIG. 1 and FIG. 2, an improved sealing strip for toner cartridges in accordance with an exemplary embodiment of the present invention includes a sealing film 1 and a double-faced sealing film 2 adhered onto the sealing film 1. The sealing film 1 includes a sealing portion 1*a* for sealing a toner chamber slot of a toner cartridge, and a pull part 1*b* extending outward along one end of the sealing portion 1*a*. The double-faced sealing film 2 is adhered onto the sealing portion 1*a*, and the pull part 1*b* is used for tearing the sealing portion 1*a*.

Figure 2A:
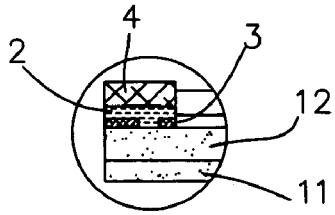
FIG. 2A is a magnified view of the FIG. 2 at the position C, further illustrating the structure at the end of sealing strip.

Referring to FIG. 2 and FIG. 2A, in one embodiment, the sealing film includes vertically (in thickness) a prime layer 11 and guide layer 12. One surface (side) of the double-faced sealing film 2 is adhered to the guide layer 12. Both ends of this surface are adhered with mono-silicon tearable paper 3, while one surface of the mono-silicon tearable paper 3 coated with silicon oil is attached to the guide layer 12, with its two edges in parallel alignment with the guide lines 12*a*. The other surface of the double-faced sealing film 2 is adhered with double-silicon tearable paper 4. When being used, the double-silicon tearable paper 4 is first removed. Then, this surface of the double-faced sealing film 2 is attached to the periphery of the toner chamber slot.

Figure 3:
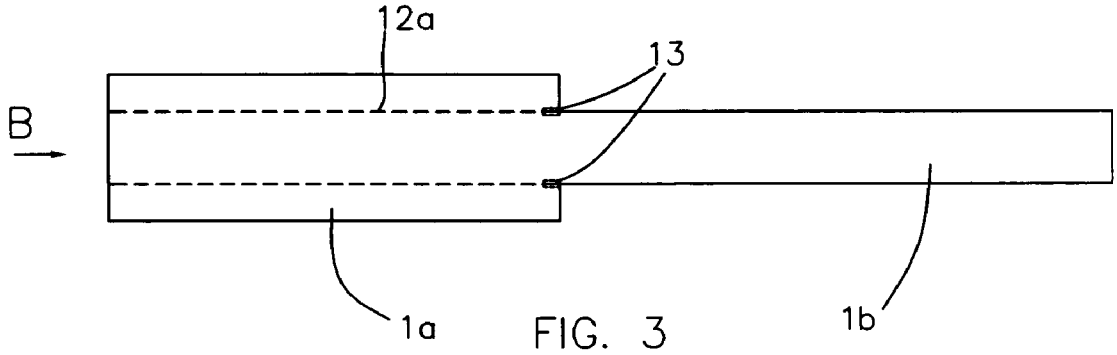
FIG. 3 is a front view of the sealing film for the sealing strip for toner cartridges shown in FIG. 1, with the positions of the two guide lines and two openings indicated in dashed lines.
Figure 4:
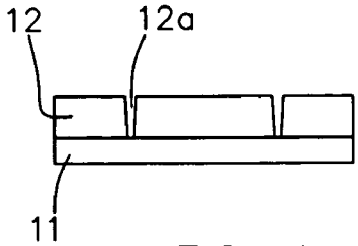
FIG. 4 is a magnified view of FIG. 3 along the direction B, indicating the sectional structure of the guide lines.

Referring to FIG. 3, two guide lines 12*a* parallel with each other are located on the guide layer 12 of the sealing film 1, and both side edges of the pull part 1*b* are respectively located on the extension lines of the two guide lines 12*a*. Referring to FIG. 4, the guide lines 12*a* are continuously guiding channels by cutting tool (indicated in dashed lines in the FIG. 3 so as to be distinguished from the other contour lines), being 30–90 μm in depth, and generally equal to the thickness of the guide layer 12. There are two openings 13 provided at the end of the sealing portion 1*a* adjacent the pull part 1*b*, and the two openings 13 respectively intersect the two guide lines 12*a* (the position of the two openings 13 is indicated in a small dashed line frame in FIG. 3), with the two openings 13 both ranging in 0.5–3.5 mm (preferably 0.8–2.5 mm) in length, which may make the sealing film easy to tear without toner leakage.

Figure 5:
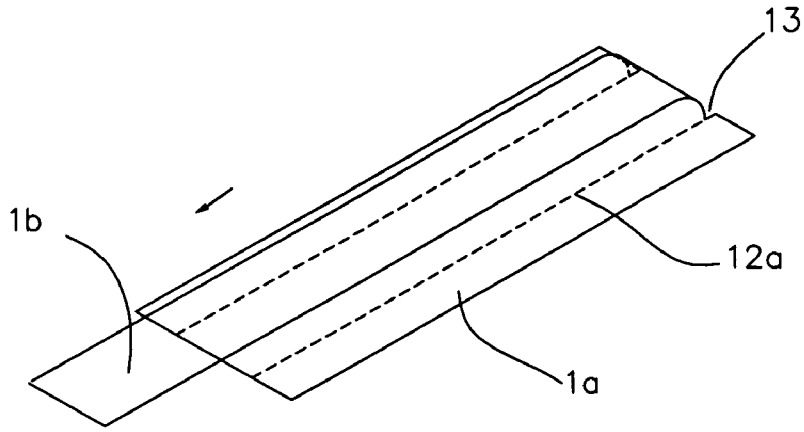
FIG. 5 is schematic drawing indicating the initial state when the sealing portion of the sealing film in accordance with an exemplary embodiment of the present invention is pulled and torn.

As shown in FIG. 5, when tearing the sealing portion 1*a*, the pull part 1*b* is turned over by 180° and is pulled by reversed application of force (as shown by the arrow in FIG. 5). Due to the existence of the two openings 13, stress concentration occurs at the beginning end of the tearable portion between the two guide lines, making it easy to tear and convenient to pull. This may solve the foregoing-described problem (e.g., becoming broadened, narrowed or obliquely pulled, laminated etc. after being torn out).

Referring back to FIG. 1, the double-silicon tearable paper 4 and the double-faced sealing film 2 are both in the form of a circular arc, and are attached to the periphery of the sealing film 1, and the inner borders on both sides are substantially in parallel alignment with the two guide lines 12*a* (FIG. 1 indicates the state that both are completely in parallel alignment with each other), with the offset distance there between less than 0.3 mm. The prime layer 11 is made of monoaxial or biaxial oriented polypropylene (OPP or BOPP), with a thickness of 25–35 μm (preferably 30 μm). The guide layer 12 is made of polyethylene resin or polypropylene resin (PET), with a thickness of 35–60 μm (preferably 48 μm).

Figure 6:
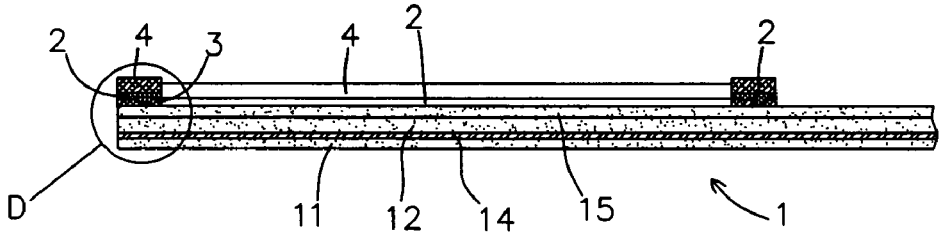
FIG. 6 is a sectional view of another embodiment of the sealing strip for toner cartridges in accordance with an exemplary embodiment of the present invention.
Figure 6A:
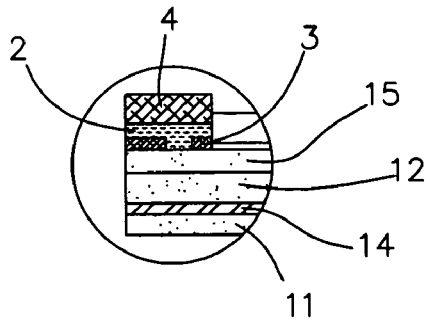
FIG. 6A is a magnified view of FIG. 6 at the position D, further illustrating the structure at the ends of sealing strip in this embodiment.

Referring to FIGS. 6 and 6*a*, as another embodiment of this invention, the sealing film 1 includes an aluminum foil layer 14 between the prime layer 11 and the guide layer 12 for electrostatic prevention, which is preferably 7–12 μm thick. A protection layer 15 is provided on the lateral surfaces of the guide layer 12, and the protection layer is made of cast polypropylene (CPP) with a thickness of 30–60 μm. CPP's better flexibility and higher flatness may guarantee the accurate control on the cutting depth of the cutting guide lines, external contours and said openings. One surface (side) of the double-faced sealing film 2 is adhered to the protection layer 15, with mono-silicon tearable paper 3 adhered on both ends of this surface. A silicon oil coated surface of the mono-silicon tearable paper 3 is attached to the protection layer 15. The other surface of the double-faced sealing film 2 is adhered with tearable double-silicon paper 4. In this embodiment, the sealing film 1 is a four layer structure. Alternatively, the sealing film 1 is a three layer structure (e.g., including only the prime layer 11, the guide layer 12 and the aluminum foil layer 14, or including only the prime layer 11, the guide layer 12 and the protection layer 15). In the case of a four layer structure or three layer structure, in terms of the depth of the guide line 12*a*, it is preferred to cut through the guide layer 12. It is understood that it is feasible to cut through the aluminum foil 14. However, it is not feasible to cut through the prime layer 11.

Figure 7:
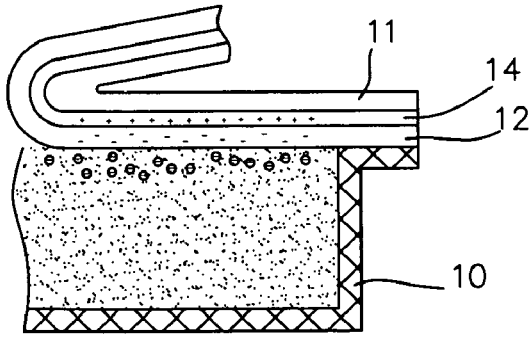
FIG. 7 is a schematic drawing illustrating the principle of using aluminum foil layers to eliminate electrostatics.

The aluminum foil layer 14 can effectively achieve electrostatic elimination, and prevent the toner from being adsorbed onto the sealing strip and carried away due to static electricity. The basic principle for electrostatic elimination is in order. Referring to FIG. 7, static electricity may be generated due to mutual friction and collision among the toner particles inside the toner chamber in the toner cartridge. When negative particles are generated, they are quite easy to be adsorbed onto the guide layer 12 or the protection layer 15, which is made from macromolecular chemical materials. When an aluminum foil layer is not present, the charged particles adsorbed onto the sealing film may be carried away when tearing the sealing film. However, when metal is in constant contact with macromolecules, electrons are generally easy to escape from the metal. Thus, with the presence of the aluminum foil layer, the electrons of the aluminum foil may drift to the guide layer and/or the protection layer which is made of macromolecular chemicals, therefore making the guide layer and/or protection layer negatively charged. Thus, the electronegative particles within a toner cartridge may not be adsorbed due to the repulsive force of the negative charges on the surface of the guide layer or protection layer, and therefore may not be carried away.

Figure 8:
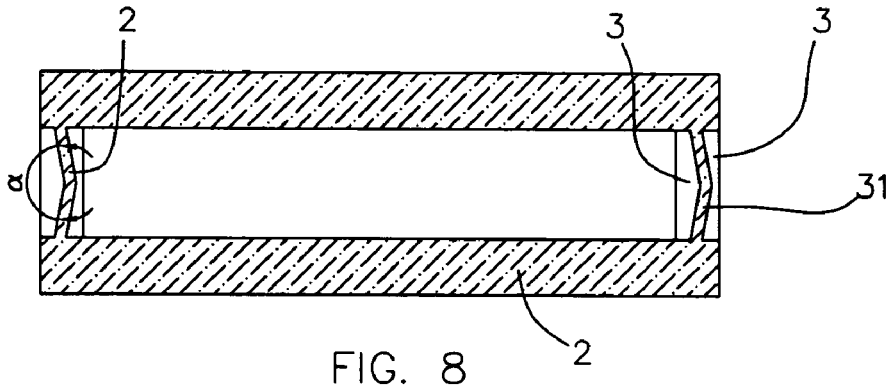
FIG. 8 is a bottom view of a double-faced sealing film in accordance with an exemplary embodiment of the present invention, illustrating the shape and position of the mono-silicon tearable paper.

Referring to FIG. 8, when a sealing strip for a toner cartridge in accordance with the present invention is used for sealing a wider toner chamber slot, the double-faced sealing film 2 is adhered with two pieces of mono-silicon tearable paper 3 at each end. The mono-silicon tearable paper 3 is shaped in the form of dovetail groove (on the right) or a wedge (on the left) which may be mated with an opening of the dovetail groove. As shown in FIG. 8, the two edges of the mono-silicon tearable paper are respectively in parallel alignment with the guide lines 12*a*, thus to ensure easy-tear. The sealant area formed between the two pieces of tearable paper after adhesion, which presents as a polygonal line segment 31 with equal breadth. The tip of the polygonal line segments 31 points to the same direction as the extending direction of the pull part 1*b*, and form a closed sealant area together with the sealants in the other areas (the area with hatching in the FIG. 8 shows the sealant area). Thus, secured adhesion may be ensured. The silicon oil coated surfaces of the two pieces of said mono-silicon tearable paper are attached to the guide layer 12 or protection layer 15, and the silicon oil may prevent the sealant liquid from entering this area (i.e. no sealant exists on the blank area shown in the FIG. 8 and sealants only exist on the polygonal line segment parts at both ends). In addition, due to the tips of the polygonal line segments directing opposite the pulling direction, it is more easy to tear both ends of the sealing portion. And the two pieces of mono-silicon tearable paper at each end may effectively prevent the sealant liquid from being carried over when the torn portion passes by both ends. As shown in FIG. 8, the polygonal line segments 31 are formed by two intersecting line segments with a constant width (2.5–3.5 mm wide). The obtuse angle (angle $\alpha$ indicated in FIG. 8) between the two line segments ranges from 100 to 130 degrees. When adhering, it may be guaranteed that the two break points of the polygonal line segments are located on the vertical center line between the two guide lines, thus making the sealing film easy to disengage from the sealant when pulling, and to tear smoothly till the end along the guide lines.

Figure 9:
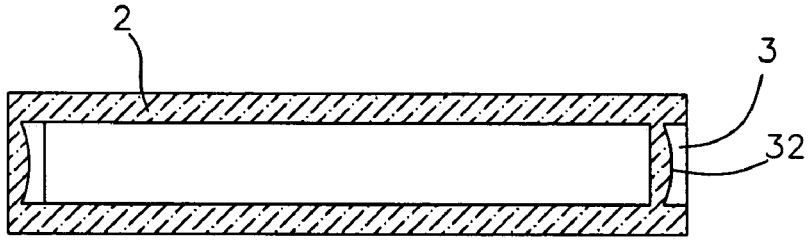
FIG. 9 is a bottom view of a double-faced sealing film in accordance with an exemplary embodiment of the present invention, illustrating the shape and position of the mono-silicon tearable paper.

Referring to FIG. 9, in the case of a narrower toner chamber slot, another implementation approach in accordance with the present invention is in order. The double-faced sealing film 2 is adhered with one piece of mono-silicon tearable paper 3 on each end, and the shape of the mono-silicon tearable paper is approximately a rectangle with one side being an arc 32 and the other three sides being straight lines, thus making one side of the sealant areas formed on both ends of the double-faced sealing film also shaped in the form of circular arc, with the convex direction of the circular arc 32 same as the extending direction of the pull part 1*b*. The two edges of this rectangle are in parallel alignment with the guide lines 12*a*, thus easy-tear may be ensured. A closed sealant area is formed by the sealant area together with the sealants in the other areas. The mono-silicon tearable paper 3 in this implementation approach may also function as described before, however it is more applicable for toner cartridges with a narrower toner chamber slot.

In general, a method for manufacturing the sealing strip for toner cartridges in accordance with the present invention including following steps:

1) respectively making the sealing film and double-faced sealing film sheet, with the sealing film including a prime layer 11 and guide layer 12, and the double-faced sealing film sheet is made according to the shape and dimensions of the sealing portion 1*a* of the sealing film 1; and
2) adhering the double-faced sealing film sheet onto the sealing film, thus obtain the sealing strip for a toner cartridge.

In step 1), the guide lines 12*a*, openings 13 as well as the external contours of the sealing portion 1*a* and pull part 1*b* on the sealing film are all cut out by a cutter's cutting knife; the cutter may be a single knife rest cutter or a double knife rest cutter.

In one implementation approach in accordance with the present invention, the sealing film 1 is a two layer structure including a prime layer and a guide layer. The procedure for making the two-layer sealing film includes a step of making the sealing film blank and a step of cutting the sealing film blank for making sealing films, as show below. The step of making sealing film blanks includes following two steps:

1) respectively selecting an appropriate thickness of monoaxial or biaxial oriented polypropylene (OPP or BOPP) as the primer film, an appropriate thickness of aluminum foil as the foil layer film, and an appropriate thickness of polyethylene resin or polypropylene resin (PET) as the guide layer film, and an appropriate thickness of cast polypropylene as the protection layer film, and combing the primer film and guide layer film into a composite film by means of dry composition. Generally, the thickness of primer film is selected as 30–40 μm, 50–80 μm for the guide layer film. The method of dry composition refers to: firstly applying adhesives on the adhesion surfaces of the both films, then adhering the surfaces thereof to each other after air drying, and completely bonding them by pressurization. The dry composition mentioned hereinbelow is the same; and
2) cutting the composite film into rectangular sealing film blanks 20 according to the dimension requirements specified by the graphics file for the selected model of sealing film, with each rectangular sealing film blank including multiple sealing films.

Figure 10A:
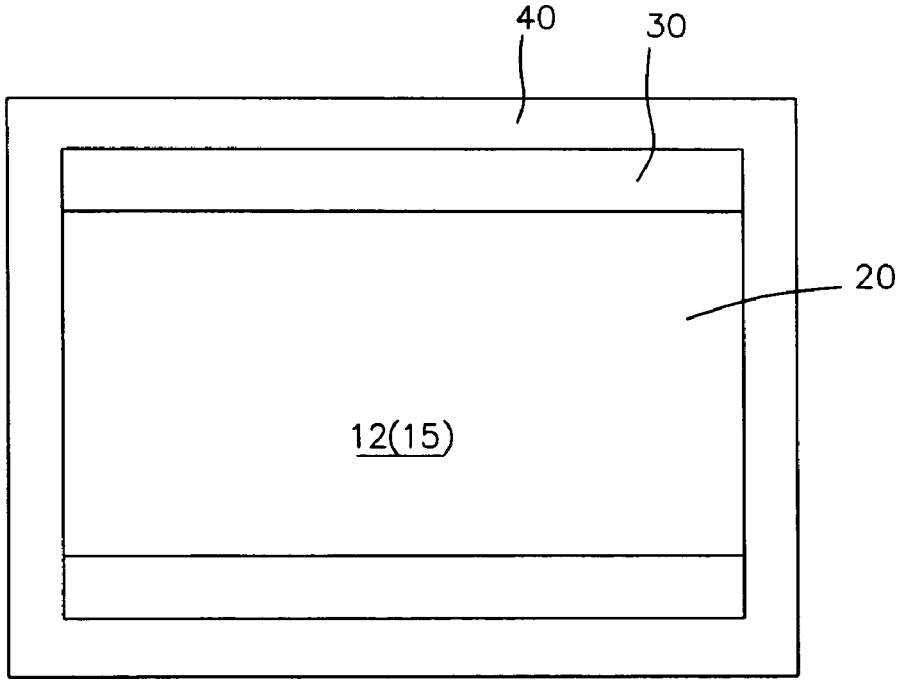
FIG. 10A is a schematic drawing showing a situation when a rectangular sealing film blank is positioned on the locating paper board and the locating paper board is fastened on the cutter's working bench in accordance with an exemplary embodiment of the present invention.
Figure 10B:
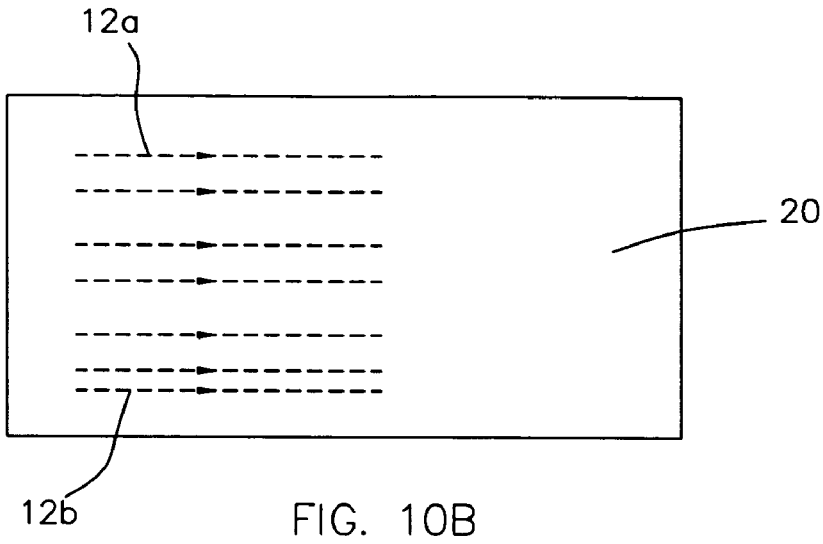
FIG. 10B a schematic drawing showing a sequence for a cutting knife to cut guide lines on sealing film blanks in accordance with an exemplary embodiment of the present invention.
Figure 10C:
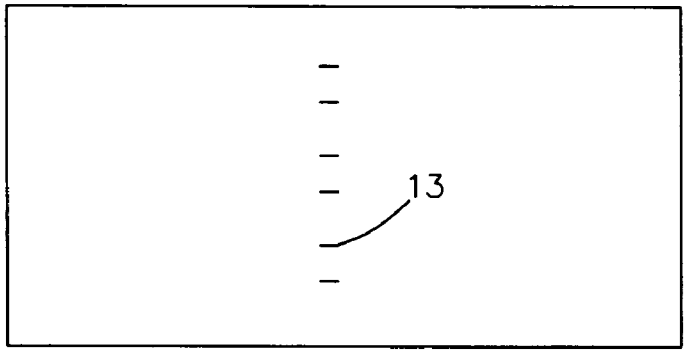
FIG. 10C a schematic drawing showing a sequence for a cutting knife to cut openings on sealing film blanks in accordance with an exemplary embodiment of the present invention.
Figure 10D:
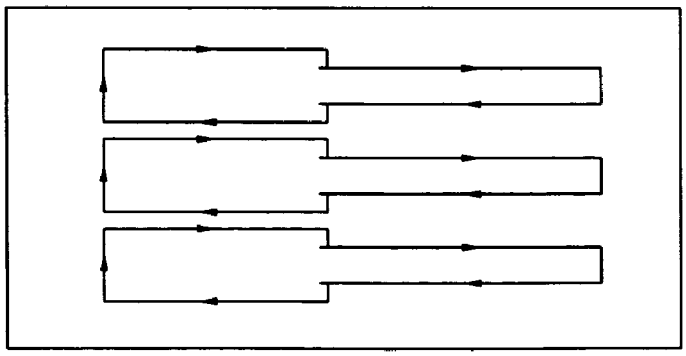
FIG. 10D a schematic drawing showing the track for a cutting knife to cut the external contour of sealing film on sealing film blank in accordance with an exemplary embodiment of the present invention.

After acquisition of the rectangular sealing film blank, cutting is followed. Using a single knife rest cutter, the step of cutting the sealing film blank for making sealing films is as follows:

1) positioning: referring to FIG. 10A, adhering, smoothly and evenly, the sealing film blank 20 to the locating paper board 30 having temporarily locating adhesives, and making the guide layer 12 face outwards; then fastening the locating paper board 30 on a proper position on the cutter's working bench 40, making the surface adhered with the sealing film blank face upwards;
2) cutting guide lines: setting up the cutter's knife pressure, knife speed and blade extending distance, then starting the cutter to cut out multiple guide lines in parallel with each other, the track for guide line cutting being indicated by arrow in FIG. 10B, and pausing the cutter after cutting the last guide line; and
3) cutting the openings and external contour of sealing film: resetting the cutter's knife pressure, knife speed and blade extending distance, then starting the cutter to cut out the openings and external contour for multiple individual sealing films from the sealing film blank, thus obtaining multiple finished sealing film products including sealing portion 1*a* and pull part 1*b*. The cutting sequence is indicated specifically as in FIGS. 10C and 10D. Generally the opening is first cut, then the contour is cut.

Using a double knife rest cutter, the step of cutting the sealing film blank for making sealing films is as follows:

1) same as the above step 1), i.e. positioning
2) respectively setting up the knife pressure, knife speed and blade extending distance for each knife rest, then starting the cutter to move one knife rest, with a cutting knife fastened thereon cutting out multiple guide lines in parallel with each other, and automatically lifting this knife rest after finishing the last guide line, then, move the other knife rest, with the cutting knife fastened thereon cutting out the openings and external contour for multiple individual sealing films from the sealing film blank (with a cutting sequence of first cutting the opening, then cutting the contour), thus obtaining multiple finished sealing film products including sealing portion 1*a* and pull part 1*b*.

Preferably, when cutting the sealing films with the structure only including two layers, the cutter's knife pressure, knife speed and blade extending distance for cutting guide lines are respectively set as 100 gf, 20 cm/s and 0.02–0.04 mm, and those for cutting the external contour and the openings are respectively set as 200 gf, 30 cm/s and 0.1–0.2 mm.

In another embodiment, the sealing film 1 also includes an aluminum foil layer 14 clamped and held between the prime layer 11 and guide layer 12, and a protective layer 15 positioned on the lateral surface of the guide layer 12. That is, the sealing film 1 is a four layer structure including the prime layer 11, the guide layer 12, the foil layer 14 and the protection layer 15, with its cross section shown in FIG. 7. According to an exemplary embodiment of the present invention, the procedure for making the four layer sealing film includes a step of making the sealing film blank and a step of cutting the sealing film blank for making sealing films, as show below. The step of making sealing film blanks includes following two steps:

1) respectively selecting an appropriate thickness of monoaxial or biaxial oriented polypropylene as the primer film, an appropriate thickness of aluminum foil as the foil layer film, an appropriate thickness of polyethylene resin or polypropylene resin as the guide layer film, and an appropriate thickness of cast polypropylene as the protection layer film, and combining these layer films in the order of primer film, aluminum foil layer, guide layer and protection layer to form a composite film by means of dry composition; and 2) cutting the composite film into rectangular sealing film blanks 20 according to the dimension requirements specified by the graphics file for the selected model of sealing film, with each rectangular sealing film blank including multiple sealing films.

After acquisition of the rectangular sealing film blank, cutting is followed. Using a single knife rest cutter, the step of cutting the sealing film blank for making sealing films is as follows:

1) positioning (referring to FIG. 10A): adhering, smoothly and evenly, the sealing film blank to the locating paper board 30 having temporarily locating adhesives, and making the protection layer 15 face outwards, then fastening the locating paper board 30 on a proper position on the cutter's working bench 40, and making the surface adhered with the sealing film blank face upwards;

2) cutting guide lines: setting up the cutter's knife pressure, knife speed and blade extending distance, then starting the cutter to cut out multiple guide lines in parallel with each other (the cutting sequence being same as that in the case of a two layer structure), and pausing the cutter after cutting the last guide line; and 3) cutting the openings and external contour of sealing film: resetting the cutter's knife pressure, knife speed and blade extending distance, starting the cutter to cut out the openings and external contour for multiple individual sealing films from the sealing film blank, thus obtaining multiple finished sealing film products including sealing portion 1*a* and pull part 1*b* (the specific cutting sequence is the same as that mentioned above).

Using a double knife rest cutter, the step of cutting the sealing film blank for making sealing films is as follows:

1) same as the above step 1), i.e., positioning; and 2) respectively setting up the knife pressure, knife speed and blade extending distance for each knife rest, then starting the cutter to move one knife rest, with the cutting knife fastened thereon cutting out multiple guide lines in parallel with each other, automatically lifting this knife rest after finishing the last guide line, then move the other knife rest, with the cutting knife fastened thereon cutting out the openings and contour for multiple individual sealing films from the sealing film blank, thus obtaining multiple finished sealing film products including sealing portion 1*a* and pull part 1*b*.

When cutting the sealing films with a four layer structure, the cutter's knife pressure, knife speed and blade extending distance for cutting guide lines are respectively set as 160 gf, 15 cm/s and 0.05–0.1 mm, and those for cutting the external contour and the openings 13 are respectively set as 220 gf, 25 cm/s and 0.3–0.4 mm.

In the foregoing-described method, the model CE2000–60 or CE3000–60 numerical cutter with a single knife rest, manufactured by Japanese Graphtec Co. Ltd., may be used, and the FC4210–60 or FC3500 numerical cutter with double knife rests, manufactured by the same company, may be used.

Figure 10E:
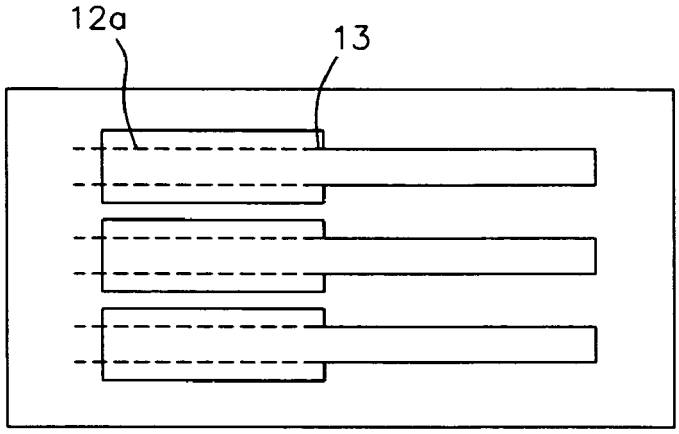
FIG. 10E a schematic drawing showing the track for overlapping the guide lines, openings and external contour in accordance with an exemplary embodiment of the present invention.

Preferably, when cutting the sealing films, the cutter's cutting operation is performed under the control of computer such as a personal computer (PC), with the specific procedures described as follows. After the knife pressure, knife speed and blade extending distance are set up, the graphic file of sealing film pre-stored in the PC is opened, and the PC is operated to send a cutting command to the cutter. Upon receiving the cutting command, the cutter manipulates the movement of the cutting knife thereof in accordance with the track defined by the graphic file stored in PC to cut the sealing film blank. With respect to a single knife rest cutter, since only one cutting knife can be installed, the knife pressure, knife speed and blade extending distance have to be reset after finishing the guide lines in order to cut the external contour and the openings. With respect to a double knife rest cutter, two cutting knife may be installed at the same time: one used for cutting guide lines and the other for cutting the external contour and the openings. Thus, the knife pressure, knife speed and blade extending distance can be preset simultaneously for the two cutting knives. Then, the cutter is started. After finishing the guide lines, the cutter may automatically switch the cutting knifes to cut the openings and external contour. Referring to FIG. 10E, the length of the guide lines cut out is longer than that of the guide lines cut on an individual sealing film (i.e. overrunning the external contour of the sealing portion 1*a*).

The graphics file is a file that is prepared according to the shape and dimensions of a different model of sealing strip, pre-stored in a PC and used for controlling the movement track of the cutter's cutting knife. In terms of the portions having no graphics (e.g. the portion between two guide lines as shown in FIG. 10B) in the graphic file, the cutting knife may be lifted automatically to avoid scuffing the sealing film. In addition, in the case of a protection layer positioned on the lateral surface of the guide layer, the protection layer may effectively protect the guide layer and prevent the guide layer from scuffing by the cutting knife.

Referring to FIG. 10B, when using a single knife rest cutter, the last guide line 12*b* defined by the graphics file for the sealing film is the buffer line for a pause. The pause buffer line functions as follows. Upon completion of guide lines, the cutting knife needs a pause. Therefore, a pause buffer line, which has a certain distance from the last guide line and is used for suspending the cutting knife, is set up in order to prevent the cutting knife from scuffing the peripheral portions around the guide lines since the cutting knife may not stop at the correct position (endpoints of the guide line).

Figure 11A:
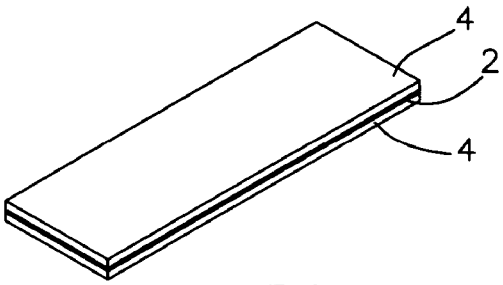
FIG. 11 A is a three-dimensional drawing showing a situation when a double-faced sealing film is unfolded and adhered with tearable paper on both sides in accordance with an exemplary embodiment of the present invention.
FIG. 11B is a three-dimensional drawing showing the double-faced sealing film of FIG. 11A after die cutting in accordance with an exemplary embodiment of the present invention.
FIG. 11C shows shape of multiple mono-silicon tearable papers in accordance with exemplary embodiments of the present invention.
Figure 11B:
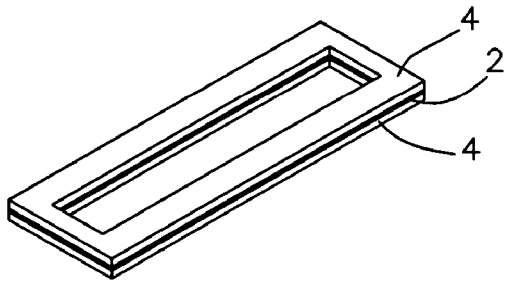
Figure 11C:
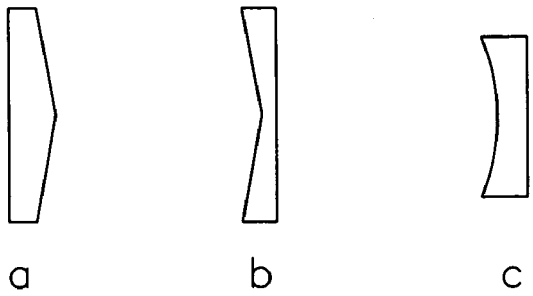

The step for adhering the double-faced sealing film sheet onto the sealing film, thus obtain the sealing strip for a toner cartridge includes steps as follows:

1) unfolding the double-faced sealing film, making one surface adhered to a double-silicon tearable paper, and another surface adhered to a mono-silicon tearable paper, or making its both surfaces adhered with a double-silicon tearable paper (the resulting three layer structure is shown in FIG. 11A);

2) making die cutting on the double-faced sealing film sheet which is adhered with double-silicon tearable paper and mono-silicon tearable paper or adhered only with double-silicon tearable paper, and making long through holes thereof in the center (the structural shape after die cutting is shown in FIG. 11B), meanwhile ensuring the width of the holes equal to the distance between the two guide lines and the length equal to that of the toner chamber slot of a toner cartridge;

3) selecting another piece of mono-silicon tearable paper, securing it on the cutter, then cutting out multiple mono-silicon tearable paper pieces in accordance with the selected model of sealing film (see FIG. 11C where three different shapes (a, b, c) of the multiple mono-silicon tearable paper pieces according to the selected models of sealing films are shown. Shape a and shape b are respectively in the form of dovetail groove and its mated wedge, and the two shapes of paper pieces are commonly used in combination and for sealing a toner chamber with a wider slot. Shape c is like a rectangle with one side being an arc and the other three sides being straight lines, and this shape of mono-silicon tearable paper is normally used for sealing a toner chamber with a narrower slot); and 4) fixing up the double-faced sealing film sheet which has been processed via step 2) above on a planar operation panel, making one surface of the mono-silicon tearable paper or the double-silicon tearable paper adhered thereto later face outwards, stripping off the mono-silicon tearable paper or double-silicon tearable paper from this surface; then adhering to a proper position on this surface the mono-silicon tearable paper piece cut out in step 3) above, thus acquiring the double-faced sealing film sheet shown in FIG. 8 or FIG. 9.

Figure 12:
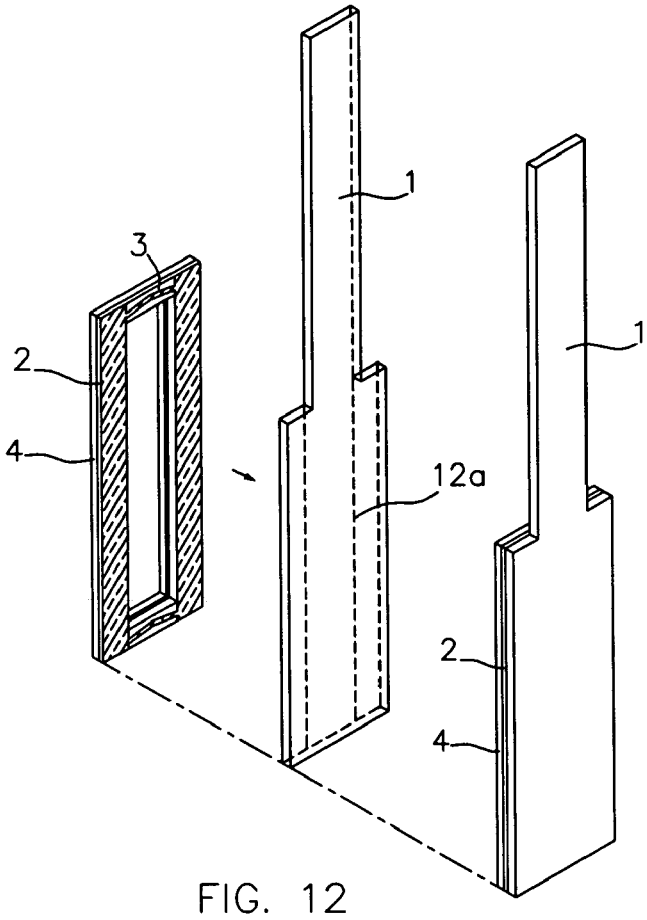
FIG. 12 is a schematic drawing illustrating steps for adhering a double-faced sealing film to a sealing film in accordance with an exemplary embodiment of the present invention.
Figure 13:
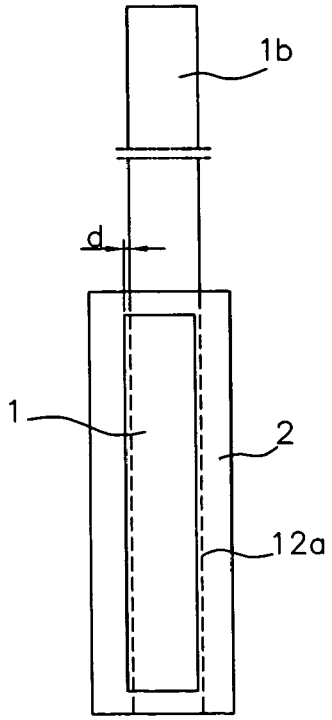
FIG. 13 is a schematic drawing indicating a position error when adhering the double-faced sealing film to a sealing film in accordance with an exemplary embodiment of the present invention.

Referring to FIG. 12, after completing making the sealing film and the double-faced sealing film sheet, they are adhered together to each other. Prior to adhesion, the finished sealing film products are preferably checked and inspected. With respect to those acceptable products, the double-faced sealing film is adhered onto the sealing film. When adhering, it should be ensured that the inner borders of the double-faced sealing film at both sides are substantially in parallel alignment with the two guide lines 12*a*, as shown in FIG. 13. Preferably, a tolerable offset distance of less than 0.3 mm is guaranteed in the case of any offset. Thus, a finished product of the sealing strip for a toner cartridge is acquired.

The method for making the sealing strip for toner cartridges in accordance with the present invention has following advantages. First, in comparison with conventional techniques, the guide lines, openings as well as the external contours of the sealing portion and guiding portion on a sealing film are all cut out by the cutter's cutting knife, and are accomplished by a single cutter in the same processing cycle and in the same loading and clamping, therefore it can be guaranteed that the manufactured sealing film has a higher degree of precision. In addition, since both side edges of the pull part are respectively located on the extension lines of the two guide lines, thus making the sealing strip able to tear smoothly along the two guide lines, without the occurrence of the problems like becoming broadened, narrowed or obliquely pulled, and laminated. Furthermore, guide lines, openings and their external contours may be cut out for multiple sealing strips, thus the production efficiency is greatly enhanced, with the production costs lowered at the same time due to lower cutter cost. Moreover, the present method is provided with good flexibility and quite strong adaptability, which is not only applicable for the mass production of the same model sealing strips, but may also satisfy the demand for the production of sealing films of multiple models in small lots.

It is understood that the specific order or hierarchy of steps in the processes disclosed is an example of exemplary approaches. Based upon design preferences, it is understood that the specific order or hierarchy of steps in the processes may be rearranged while remaining within the scope of the present invention. The accompanying method claims present elements of the various steps in a sample order, and are not meant to be limited to the specific order or hierarchy presented.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A sealing strip for a toner cartridge, comprising:

a sealing film (1) including, along a first direction, a sealing portion (1*a*) for sealing a toner chamber slot of a toner cartridge and a pull part (1*b*) extending along one end of said sealing portion (1*a*), said pull part (1*b*) being used for tearing away said sealing portion (1*a*), said sealing portion (1*a*) including two openings (13) adjacent said pull part (1*b*), said two openings (13) ranging from 0.5 to 3.5 millimeters in length; and a double-faced sealing film (2) adhered to said sealing portion (1*a*), wherein said sealing film (1) includes, along a second direction substantially perpendicular to said first direction, a prime layer (11) and a guide layer (12), said guide layer (12) including two guide lines (12*a*) substantially parallel to each other and extending along said first direction, said two guide lines (12*a*) intersecting said two openings (13).

2. The sealing strip of claim 1, wherein said two openings (13) range from 0.8 to 2.5 millimeters in length.

3. The sealing strip of claim 2, wherein two side edges of said pull part (1*b*) and said two guide lines (12*a*) are positioned, along said first direction, on two straight lines, and said two guide lines (12*a*) are formed by cut lines having a depth of 30–90 micrometers.

4. The sealing strip of claim 2, wherein a first side of said double-faced sealing film (2) is adhered to said guide layer (12), two pieces of mono-silicon tearable paper (3) are adhered to said first side of said double-faced sealing film (2) at both ends, with a silicon oil coated surface of said two pieces of mono-silicon tearable paper (3) being attached to said guide layer (12) and two edges of said two pieces of mono-silicon tearable paper (3) being in parallel alignment with said two guide lines (12*a*), and tearable double-silicon paper (4) is attached to a second side of said double-faced sealing film (2).

5. The sealing strip of claim 4, wherein a first piece of said two pieces of mono-silicon tearable paper (3) is in a form of a dovetail groove, a second piece of said two pieces of mono-silicon tearable paper (3) is in a form of a wedge suitable for mating with an opening of said dovetail groove, and a sealing area formed between said two pieces of mono-silicon tearable paper (3) presents as a polygonal line segment (31) with equal width, with a tip of said polygonal line segments (31) pointing to an extension direction of said pull part (1*b*).

6. The sealing strip of claim 4, wherein said two pieces of mono-silicon tearable paper (3) are shaped like a rectangle with one side being a circular arc (32) and other three sides being straight lines, with a convex direction of said arc (32) pointing to an extending direction of said pull part (1*b*).

7. The sealing strip of claim 4, wherein said tearable double-silicon paper (4) and said double-faced sealing film (2) are both circular, said prime layer (11) is made of monoaxial or biaxial oriented polypropylene with a thickness of 25–35 micrometers, and said guide layer (12) is made of polyethylene resin or polypropylene resin with a thickness of 35–60 micrometers.

8. The sealing strip of claim 2, wherein said sealing film (1) includes, along said second direction, an aluminum foil layer (14) between said prime layer (11) and said guide layer (12) for electrostatic prevention, said aluminum foil layer (14) being 7–12 micrometers thick, and said guide layer (12) is attached to a protection layer (15) made of cast polypropylene (CPP) and being 30–60 micrometers thick.

9. The sealing strip of claim 8, wherein a first side of said double-faced sealing film (2) is adhered to said protection layer (15), two pieces of mono-silicon tearable paper (3) are adhered to said first side of said double-faced sealing film (2) at both ends, with a silicon oil coated surface of said two pieces of mono-silicon tearable paper (3) being attached to said protection layer (15) and two edges of said two pieces of mono-silicon tearable paper (3) being in parallel alignment with said two guide lines (12*a*), and tearable double-silicon paper (4) is attached to a second side of said double-faced sealing film (2).

10. The sealing strip of claim 9, wherein said two pieces of mono-silicon tearable paper (3) are shaped like a rectangle with one side being a circular arc (32) and other three sides being straight lines, with a convex direction of said arc (32) pointing to an extending direction of said pull part (1*b*).

11. The sealing strip of claim 9, wherein a first piece of said two pieces of mono-silicon tearable paper (3) is in a form of a dovetail groove, a second piece of said two pieces of mono-silicon tearable paper (3) is in a form of a wedge suitable for mating with an opening of said dovetail groove, and a sealing area formed between said two pieces of mono-silicon tearable paper (3) presents as a polygonal line segment (31) with equal width, with a tip of said polygonal line segments (31) pointing to an extension direction of said pull part (1*b*).

12. The sealing strip of claim 11, wherein said polygonal line segments (31) are formed by two intersecting line segments with a same width in a range of 2.5–3.5 millimeters, and an obtuse angle between said two line segments ranges from 100–130 degrees.

13. The sealing strip of claim 1, wherein two side edges of said pull part (1*b*) and said two guide lines (12*a*) are positioned, along said first direction, on two straight lines, and said two guide lines (12*a*) are formed by cut lines having a depth of 30–90 micrometers.

14. A method for manufacturing a sealing strip for toner cartridges, comprising steps of:

making a sealing film (1) including, along a first direction, a sealing portion (1*a*) for sealing a toner chamber slot of a toner cartridge and a pull part (1*b*) extending along one end of said sealing portion (1*a*), said pull part (1*b*) being used for tearing away said sealing portion (1*a*), said sealing portion (1*a*) including two openings (13) adjacent said pull part (1*b*), said two openings (13) ranging from 0.5 to 3.5 millimeters in length; and said sealing film (1) including, along a second direction substantially perpendicular to said first direction, a prime layer (11) and a guide layer (12), said guide layer (12) including two guide lines (12*a*) substantially parallel to each other and extending along said first direction, said two guide lines (12*a*) intersecting said two openings (13);

providing a double-faced sealing film (2) corresponding to a shape and dimensions of said sealing portion (1*a*); and adhering said double-faced sealing film (2) onto said sealing film (1), wherein said guide lines (12*a*), said openings (13), and external contours of said sealing portion (1*a*) and pull part (1*b*) are all cut out by a cutting tool.

15. The method of claim 14, where said making step comprises a step of making a sealing film blank and a step of cutting said sealing film blank to make said sealing film (1), said step of making a sealing film blank comprises:

selecting, a monoaxial or biaxial oriented polypropylene as a film for said prime layer, and a polyethylene resin or polypropylene resin as a film for said guide layer, and combining said film for said prime layer and said film for said guide layer into a composite film by means of dry composition; and cutting said composite film into rectangular sealing film blanks according to dimensional requirements specified by a graphics file for a selected model of said sealing film, with each rectangular sealing film blank including multiple sealing films;

and said step of cutting said sealing film blank to make said sealing film (1) comprises:

a positioning step comprising:

adhering, smoothly and evenly, said sealing film blank to a locating paper board having temporarily locating adhesives;

making said guide layer facing outward;

fastening said locating paper board on a proper position on a cutter's working bench; and making a surface adhered with said sealing film blank face upward;

a step of cutting said guide lines comprising:

setting up a cutter's knife pressure, a knife speed and a blade extending distance;

starting a cutter to cut out multiple guide lines in parallel with one another; and pausing said cutter after cutting a last guide line; and a step of cutting said openings and an external contour of said sealing film comprising:

resetting a cutter's knife pressure, a knife speed and a blade extending distance; and staring said cutter to cut out said openings and said external contour for multiple individual sealing films from said sealing film blank to obtain said sealing film including said sealing portion (1*a*) and said pull part (1*b*).

16. The method of claim 15, wherein said step of cutting said guide lines and said step of cutting said openings and an external contour of said sealing film further comprise:

after setting up said knife pressure, said knife speed and said blade extending distance, opening said graphics file pre-stored on a computer;

operating said computer to send a cutting command to said cutter; and upon receiving said cutting command, manipulating, by said cutter, a movement of said cutting knife in accordance with a track defined by said graphics file to cut said sealing film blanks.

17. The method of claim 16, wherein said last guide line defined by said graphics file for said sealing film is a pause buffer line.

18. The method of claim 14, wherein said sealing film (1) includes, along said second direction, an aluminum foil layer (14) between said prime layer (11) and said guide layer (12) for electrostatic prevention, a protection layer (15) is attached to said guide layer (12), and said making step comprises a step of making a sealing film blank and a step of cutting said sealing film blank to make said sealing film (1), said step of making a sealing film blank comprises:

selecting, a monoaxial or biaxial oriented polypropylene as a film for said prime layer, an aluminum foil as a film for said aluminum foil layer, a polyethylene resin or polypropylene resin as a film for said guide layer, and a cast polypropylene (CPP) as a film for said protection layer, and combining said film for said prime layer, said film for said aluminum foil layer, said film for said guide layer, and said film for said protection layer into a composite film by means of dry composition; and cutting said composite film into rectangular sealing film blanks according to dimensional requirements specified by a graphics file for a selected model of said sealing film, with each rectangular sealing film blank including multiple sealing films; and said step of cutting said sealing film blank to make said sealing film (1) comprises:

a positioning step comprising:

adhering, smoothly and evenly, said sealing film blank to a locating paper board having temporarily locating adhesives;

making said guide layer facing outward;

fastening said locating paper board on a proper position on a cutter's working bench; and making a surface adhered with said sealing film blank face upward;

a step of cutting said guide lines comprising setting up a cutter's knife pressure, a knife speed and a blade extending distance;

starting a cutter to cut out multiple guide lines in parallel with one another; and pausing said cutter after cutting a last guide line; and a step of cutting said openings and an external contour of said sealing film comprising:

resetting a cutter's knife pressure, a knife speed and a blade extending distance; and staring said cutter to cut out said openings and said external contour for multiple individual sealing films from said sealing film blank to obtain said sealing film including said sealing portion (1*a*) and said pull part (1*b*).

19. The method of claim 18, wherein said step of cutting said guide lines and said step of cutting said openings and an external contour of said sealing film further comprise:

after setting up said knife pressure, said knife speed and said blade extending distance, opening said graphics file pre-stored on a computer;

operating said computer to send a cutting command to said cutter; and upon receiving said cutting command, manipulating, by said cutter, a movement of said cutting knife in accordance with a track defined by said graphics file to cut said sealing film blanks.

20. The method of claim 19, wherein said last guide line defined by said graphics file for said sealing film is a pause buffer line.

21. The method of claim 18, wherein in said step of cutting said guide lines said cutter's knife pressure, said knife speed and said blade extending distance are set as 160 gf, 15 cm/s and 0.05–0.1 mm, respectively, and in said step of cutting said openings and an external contour of said sealing film said cutter's knife pressure, said knife speed and said blade extending distance are set as 220 gf, 25 cm/s and 0.3–0.4 mm, respectively.

22. The method of claim 14, where said making step comprises a step of making a sealing film blank and a step of cutting said sealing film blank to make said sealing film (1), said step of making a sealing film blank comprises:

selecting, a monoaxial or biaxial oriented polypropylene as a film for said prime layer, and a polyethylene resin or polypropylene resin as a film for said guide layer, and combining said film for said prime layer and said film for said guide layer into a composite film by means of dry composition; and cutting said composite film into rectangular sealing film blanks according to dimensional requirements specified by a graphics file for a selected model of said sealing film, with each rectangular sealing film blank including multiple sealing films; and said step of cutting said sealing film blank to make said sealing film (1) comprises:

a positioning step comprising:

adhering, smoothly and evenly, said sealing film blank to a locating paper board having temporarily locating adhesives;

making said guide layer facing outward;

fastening said locating paper board on a proper position on a cutter's working bench; and making a surface adhered with said sealing film blank face upward;

setting up, respectively, a knife pressure, a knife speed and a blade extending distance for a first knife rest and a second knife rest of a cutter;

starting said cutter to move said first knife rest to enable a cutting knife fastened to said first knife rest to cut out multiple guide lines in parallel with each other;

lifting said first knife rest after finishing a last guide line; and moving said second knife rest to enable a cutting knife fastened to said second knife rest to cut out said openings and said external contour for multiple individual sealing films from said sealing film blank to obtain said sealing film including said sealing portion (1*a*) and said pull part (1*b*).

23. The method of claim 14, wherein said sealing film (1) includes, along said second direction, an aluminum foil layer (14) between said prime layer (11) and said guide layer (12) for electrostatic prevention, a protection layer (15) is attached to said guide layer (12), and said making step comprises a step of making a sealing film blank and a step of cutting said sealing film blank to make said sealing film (1), said step of making a sealing film blank comprises:

selecting, a monoaxial or biaxial oriented polypropylene as a film for said prime layer, an aluminum foil as a film for said aluminum foil layer, a polyethylene resin or polypropylene resin as a film for said guide layer, and a cast polypropylene (CPP) as a film for said protection layer, and combining said film for said prime layer, said film for said aluminum foil layer, said film for said guide layer, and said film for said protection layer into a composite film by means of dry composition; and cutting said composite film into rectangular sealing film blanks according to dimensional requirements specified by a graphics file for a selected model of said sealing film, with each rectangular sealing film blank including multiple sealing films; and said step of cutting said sealing film blank to make said sealing film (1) comprises:

a positioning step comprising:

adhering, smoothly and evenly, said sealing film blank to a locating paper board having temporarily locating adhesives;

making said guide layer face outward;

fastening said locating paper board on a proper position on a cutter's working bench; and making a surface adhered with said sealing film blank facing upward;

setting up, respectively, a knife pressure, a knife speed and a blade extending distance for a first knife rest and a second knife rest of a cutter;

starting said cutter to move said first knife rest to enable a cutting knife fastened to said first knife rest to cut out multiple guide lines in parallel with each other;

lifting said first knife rest after finishing a last guide line; and moving said second knife rest to enable a cutting knife fastened to said second knife rest to cut out said openings and said external contour for multiple individual sealing films from said sealing film blank to obtaining said sealing film including said sealing portion (1*a*) and said pull part (1*b*).

24. The method of claim 14, wherein said providing step comprises:

unfolding a double-faced sealing film, attaching double-silicon tearable paper to a first side of said double-faced sealing film and, and attaching double-silicon tearable paper or mono-silicon tearable paper to a second side of said double-faced sealing film;

making die cutting on said double-faced sealing film attached with tearable paper to form long through holes in a center of said double-faced sealing film, and ensuring a width of said holes is equal to a distance between said two guide lines, and a length of said holes is equal to a length of a toner chamber slot for a toner cartridge, thereby obtaining die-cut double-faced sealing film;

fastening a piece of mono-silicon tearable paper to a cutter, and cutting out multiple mono-silicon tearable paper pieces in accordance with a graph for a selected model of said sealing film; and placing said die-cut double-faced sealing film on a planar operation panel with said second side of said double-faced sealing film facing outwards, peeling off said mono-silicon tearable paper or said double-silicon tearable paper from said second side of said double-faced sealing film, and attaching said multiple mono-silicon tearable paper pieces onto said second side of said double-faced sealing film.

25. The method of claim 24, wherein said multiple mono-silicon tearable paper pieces are shaped as a dovetail groove or a wedge suitable for mating with an opening of said dovetail groove.

26. The method of claim 24, wherein said multiple mono-silicon tearable paper pieces are shaped like a rectangle with one side being a circular arc and other three sides being straight lines.

27. The method of claim 14, wherein said adhering step is performed so that inner borders of said double-faced sealing film at both sides are substantially in parallel alignment with said two guide lines (12*a*).

* * * * *